United States Patent [19]

Nelson et al.

[11] Patent Number: 4,497,122

[45] Date of Patent: Feb. 5, 1985

[54] ROTARY COAL FEEDER AND DRYER

[75] Inventors: Jeffrey N. Nelson; Thomas A. Peters, both of Bethlehem, Pa.

[73] Assignee: Fuller Company, Bethlehem, Pa.

[21] Appl. No.: 352,335

[22] Filed: Feb. 25, 1982

[51] Int. Cl.[3] ..... F26B 17/20

[52] U.S. Cl. ..... 34/68; 34/166; 34/182

[58] Field of Search ..... 34/68, 166, 172, 182, 34/183; 110/104 R, 115, 222, 223, 224; 222/146 H, 368, 636; 432/223

[56] References Cited

U.S. PATENT DOCUMENTS

| | | | |
|---|---|---|---|
| 1,015,796 | 1/1912 | Gerlach | 34/166 |
| 1,331,785 | 2/1920 | Rogers et al. . | |
| 1,433,109 | 10/1922 | Brown . | |
| 1,541,903 | 6/1925 | Crites . | |
| 2,065,555 | 12/1936 | Beers | 110/115 |
| 3,151,784 | 10/1964 | Tailor . | |
| 3,556,355 | 1/1971 | Ruiz . | |
| 3,612,307 | 10/1971 | Vogt | 222/368 |
| 4,312,139 | 1/1982 | Preisler | 34/54 |

OTHER PUBLICATIONS

C-E Volumetric Feeder Dated 3-12-73; 3-19-73 and 2-1-77.

Drawings D-RE-1935-1; D-MR-10991-0: C-M-P-10239-0; B-RE-1524; C-P-10025-0 and 3-M-P-8887.

*Primary Examiner*—Larry I. Schwartz

*Assistant Examiner*—David W. Westphal

*Attorney, Agent, or Firm*—Stevens, Davis, Miller & Mosher

[57] ABSTRACT

A rotary coal feeder having a casing with a rotatable shaft having a plurality of blades defining pockets for feeding coal therethrough. The blades rotate about a hollow core and heated air passes through the core to keep the blades warm and prevent coal from sticking thereto. A chamber at the bottom of the feeder casing also has heated air passing through it to assist in drying the coal. The air exiting from the core and the chamber is directed into the coal stream.

3 Claims, 9 Drawing Figures

ROTARY COAL FEEDER AND DRYER

BACKGROUND AND SUMMARY

The present invention relates to coal feeders, and more particularly, to spider rotary coal feeders which are used to deliver a set quantity of coal over a given time period.

Raw coal feeders are typically be equipped with a hopper which is filled with coal. As the spider rotates, coal is fed into a compartment between two blades of the spider. It should be noted that this invention is equally applicable to other types of solid fuels or coarse particulate matter which fill compartments in a spider device. As the spider rotates, the coal in filled compartments drops by gravity to unload into an exit chute, the rate of fuel feed being determined by the size of the compartments and the speed of rotation of the spider.

Since the raw coal feeder just described is basically a metered feed device, it may be used to feed known quantities of fuel via a conveyor belt to a drying oven. The coal is then dried so as to improve the combustion of the coal which is eventually fed into a furnace.

When a raw coal feeder is used to deliver coal to a drying oven, it is desireable to preheat the coal prior to oven heating since this will help to prevent agglomeration of the coal. In addition, such drying will reduce the heat necessary in the drying oven stage of the coal feeding cycle to a furnace.

In the past, rotary devices have been used to feed fuel to furnaces. However, prior inventors have not been concerned with drying and heat which is generated and transmitted to a rotor device. U.S. Pat. No. 4,013,060 to Martin discloses a rotary grate with a partially hollow core which admits air into the core so that the air could flow through apertures of the cylindrical wall to contact the fuel. In this device, the air flow is used to cool the parts of the rotary grate. U.S. Pat. No. 1,433,109, to Brown discloses a spider rotary feed with cooling water circulating through an outer shell so as to disipate the heat cause by the friction of the blades of the spider against the casing. To the contrary, in the present device heated gas or air circulation is used to warm and dry the coal.

One objective of this invention is to provide a rotary coal feeder wherein coal which is being fed is heated before it leaves the rotary coal feeder.

A further objective of this invention is to heat the air found in the rotary spider compartments before it comes into contact with the coal.

A further objective of this invention is to minimize agglomeration of coal which leaves a rotary feeder.

A further objective of this invention is to avoid coal becoming stuck to the blades of a rotary coal feeder.

Further objectives will become apparent from the specification wherein a preferred embodiment is disclosed by way of example and not of limitations as shown by the attached drawings.

DETAILED DESCRIPTION

Figure 1:
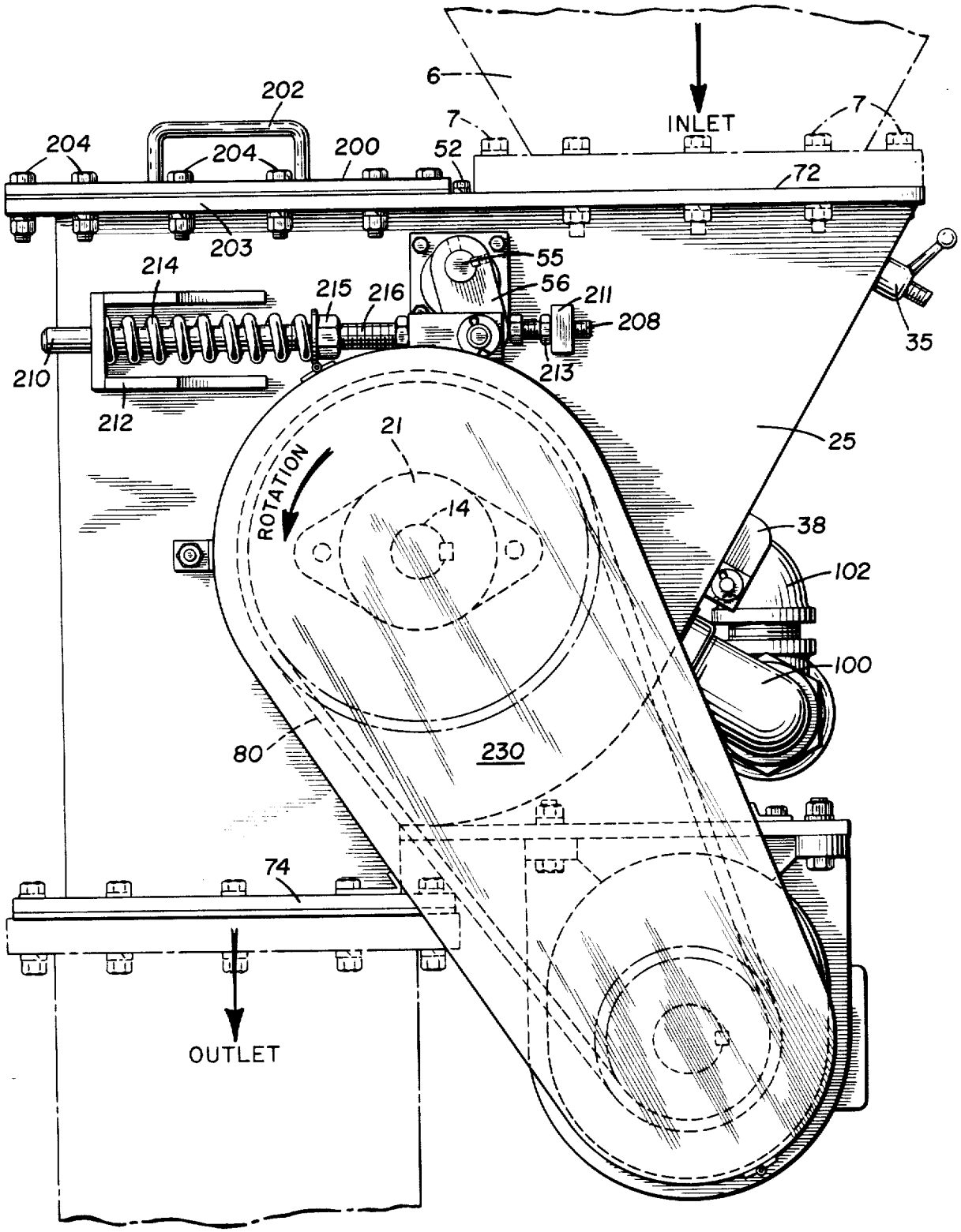
FIG. 1 is an elevational view showing one end of the coal feeder and drive.
Figure 6:
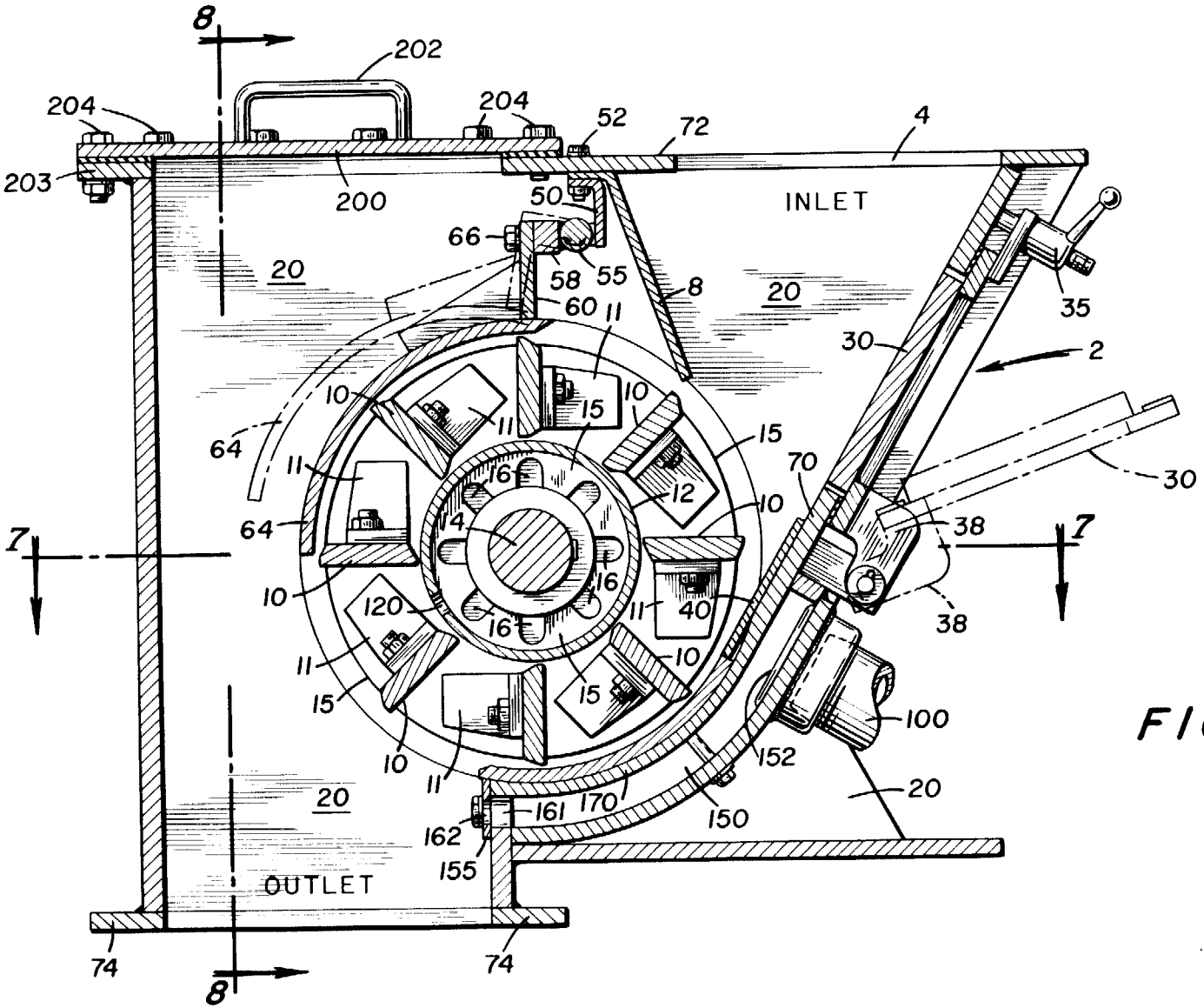
FIG. 6 is a sectional view generally taken along line 6—6 of FIG. 4.
Figure 7:
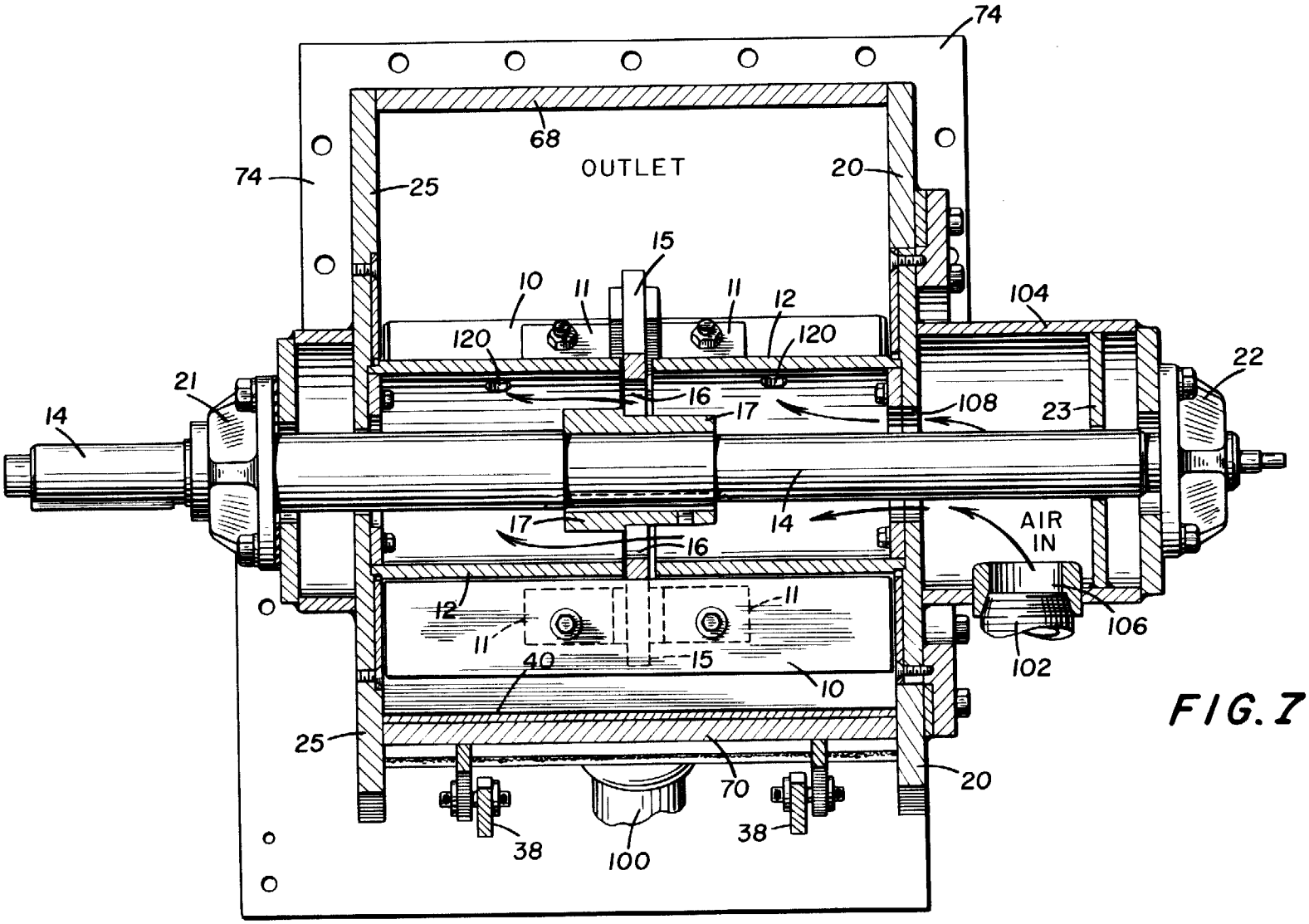
FIG. 7 is a sectional view taken along line 7—7 of FIG. 6.

Referring to the drawings in detail and beginning with FIG. 6, coal enters the rotary coal feeder 2 through inlet opening 4 to which may be attached a hopper 6 held in place by nuts and bolts 7 (see FIG. 1). The casing of the coal feeder 2 is defined by a first end wall 20 and a second end wall 25 (see FIG. 4), a first side wall 68, a second side wall 70, a top wall 72, and a bottom wall 74. A hollow cylindrical core 12 extends longitudinally through the hopper and is connected to the first end wall 20 and the second wall 25. As best seen in FIG. 7 coaxially inside the core 12, a shaft 14 is mounted for rotation in bearing 21 and 22 and extends through the end side wall 20 and the second end wall 25. A motor 230 (see FIG. 1) is drivingly connected to the shaft 14 by a chain or belt 80 by means of suitable sprockets or pulleys attached to the motor shaft and to shaft 14 which extends outwardly from the second end wall 25. The portion of the shaft 14 which extends through the first end wall 20 also extends through a plenum chamber 104 (see FIG. 7). Inside the plenum a baffle 23 is positioned near the bearing end to shield it from hot air.

Referring now to FIG. 6, as the coal enters the inlet opening 4, it will come in contact with cleanout door 30 which is normally closed and is locked by locks 35. The door 30 is connected to the second side wall 70 by a hinge means 38. On the inside bottom edge of the second side wall 70 there is located a wear plate 40 which extends down the second side wall 70 so as to cover the inner casing 170 adjacent its point of contact with the rotor blades.

Figure 2:
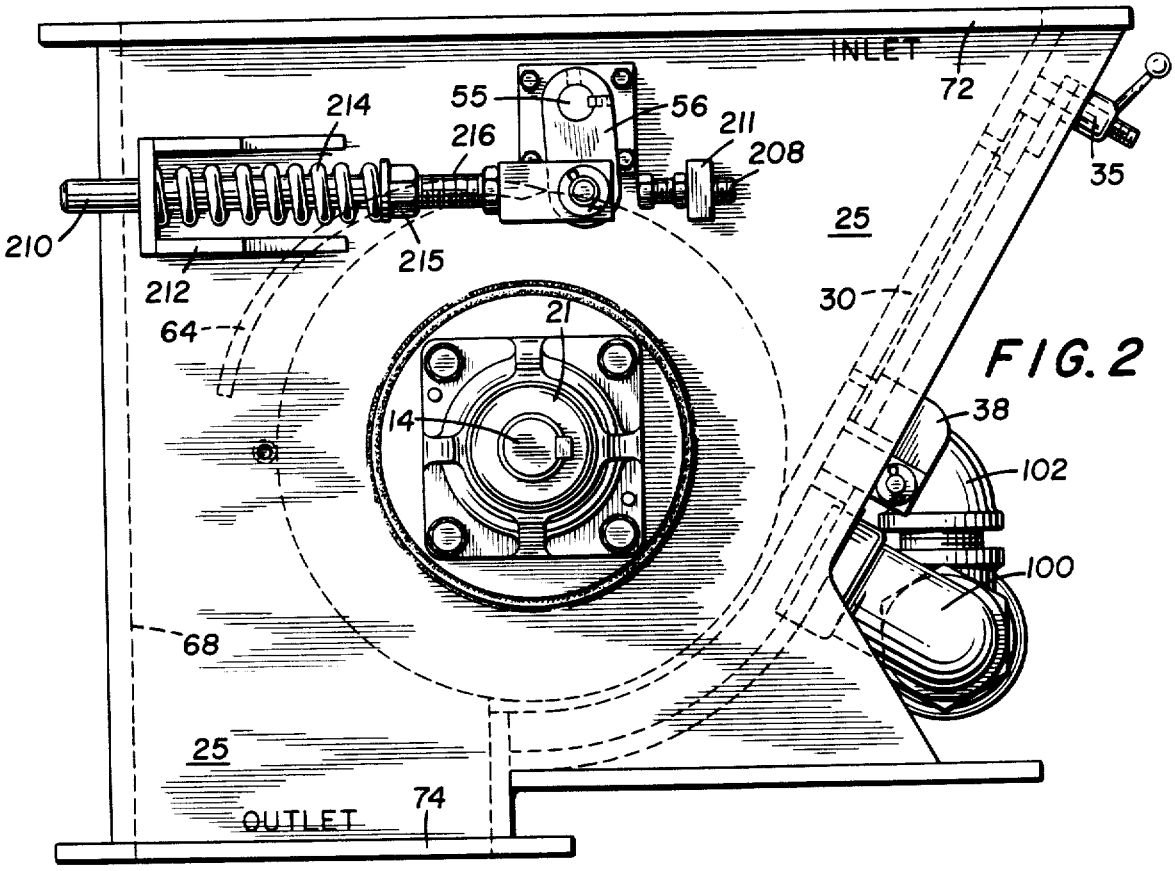
FIG. 2 is a partial end view similar to FIG. 1 with the motor removed.
Figure 3:
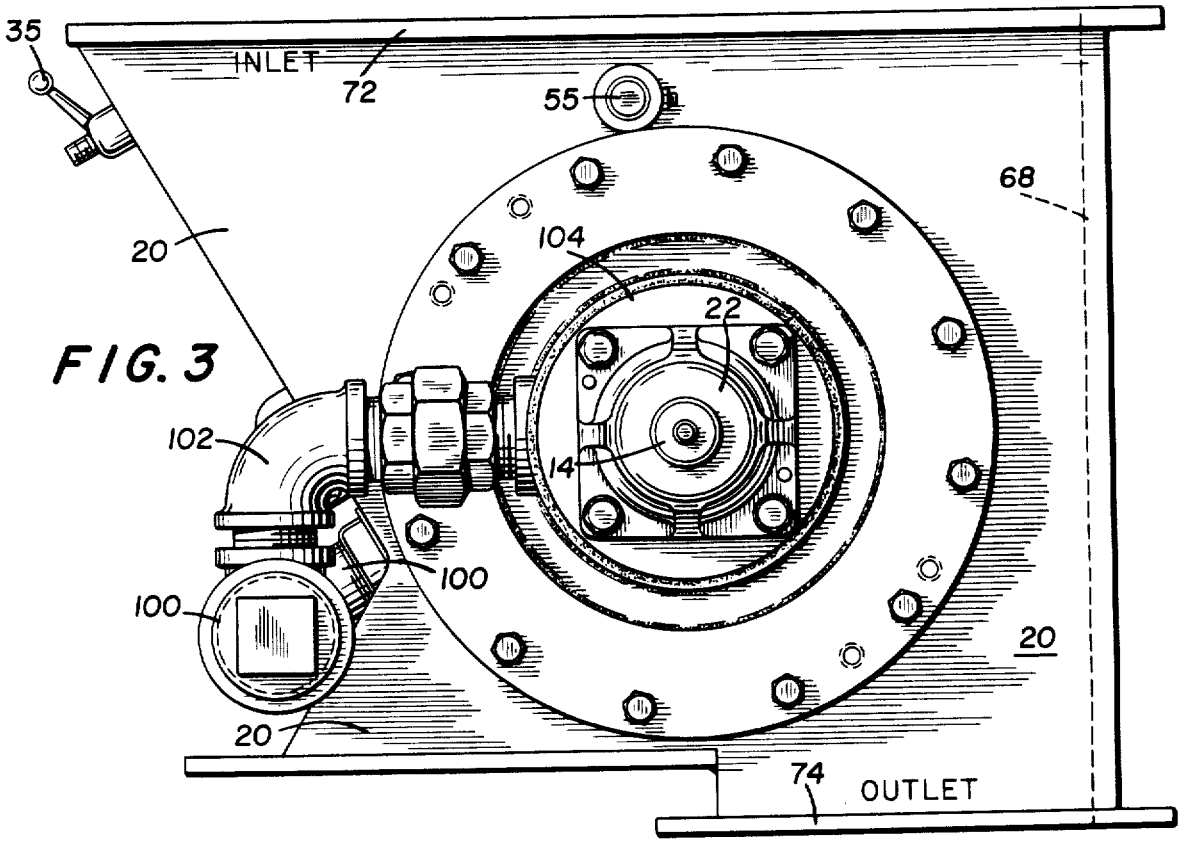
FIG. 3 is an elevational view showing the other end of the coal feeder.

As the coal enters inlet opening 4, it also encounters plate 8 which extends downwardly at an angle from top wall 72 and is secured by nut and bolt 52. The plate 8 is at an angle less than 90 degrees relative to the top plate 72 and serves as a deflection plate for entering coal. During rotation of the shaft 14, the blades 10 move in a counterclockwise circular path (as viewed in FIG. 6) from the discharge opening 5 so as to rotate past the second side wall 70 before they come into contact with coal which enters through the inlet opening 4. Therefore, plate 8 limits the amount of coal which may be carried between two consecutive blades 10 which rotate about core 12. Should a large chunk of coal get past plate 8, it will encounter the tramp plate 64 which will pivot to release such large chunks from the rotary blades so as to prevent damage to the rotary coal feeder. Still referring to FIG. 6, the tramp plate 64 is attached to plate 60 which is mounted to block 58, connected to rod 55. Block 58 may pivot with respect to the axis of pivot rod 55 which is in turn pivotally connected to brace 50. Brace 50 is attached to the top wall 72 by nut and bolt 52. The plate 60 is connected to block 58 by nut and bolt 66. As seen in FIGS. 1 and 2 the position of the tramp plate 64 is controlled by rod 55 which is attached at the second end wall 70 to arm 56 which is connected to support 57 which is attached to a threaded rod 210. Rod 210 extends through an opening in U-bracket 212 and is biased by spring 214 which in turn is held in place by nut 215 on the thread 216 of the rod 210. Support 57 is seen at rest in FIG. 1 against head 209 of bolt 208 which is threaded into dog 211 and held in place by lock nut 213. Thus, FIG. 1 shows rod 210 in its rest position when tramp plate 64 is in its closed or rest position. When tramp plate 64 is moved by coal (as seen in phantom lines in FIG. 6), support 57 is moved away from bolt 208 as depicted in FIG. 2.

A top door 200 has handles 202 and is connected by nuts and bolts 204 to a flange 203 formed at the intersection of the top wall 72 and the first side wall 68.

Figure 8:
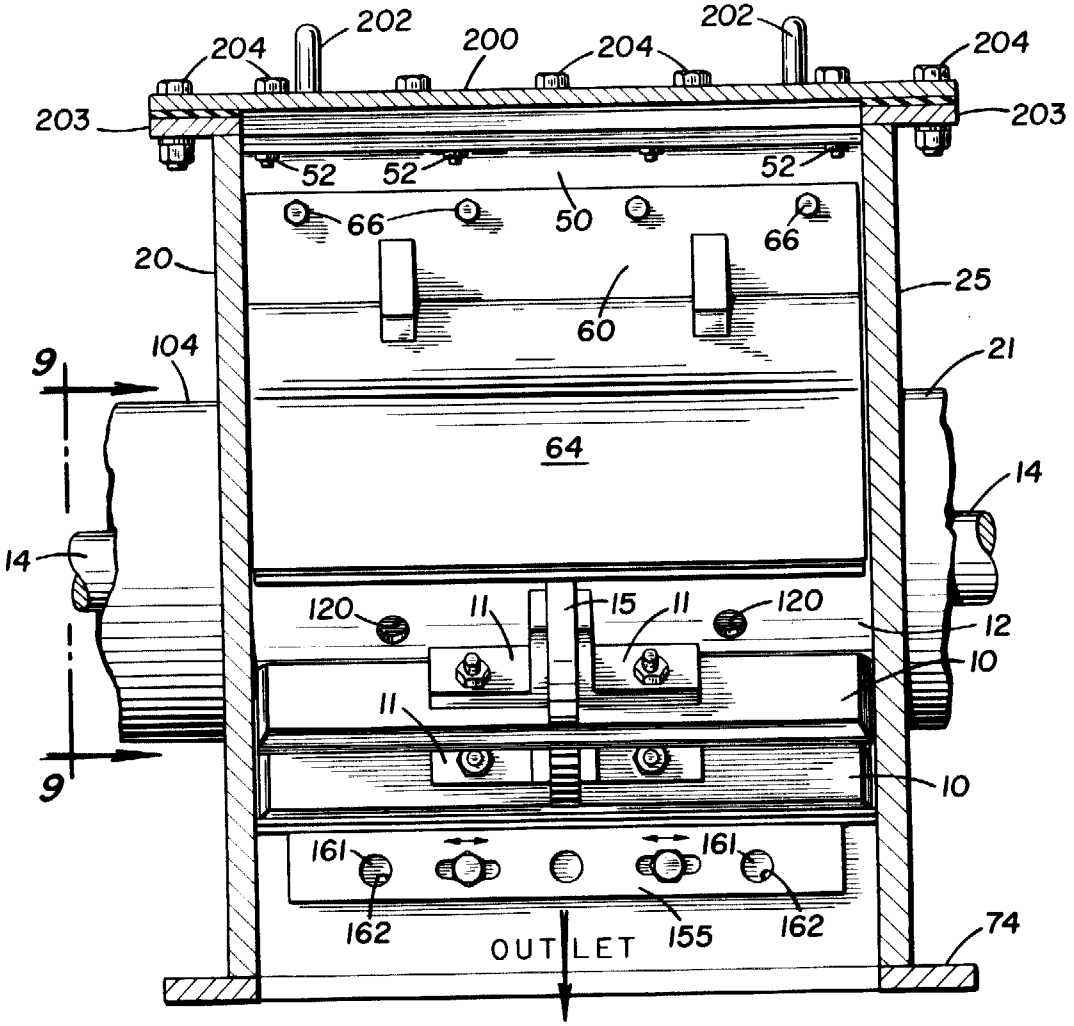
FIG. 8 is a sectional view taken along line 8—8 of FIG. 6.
Figure 9:
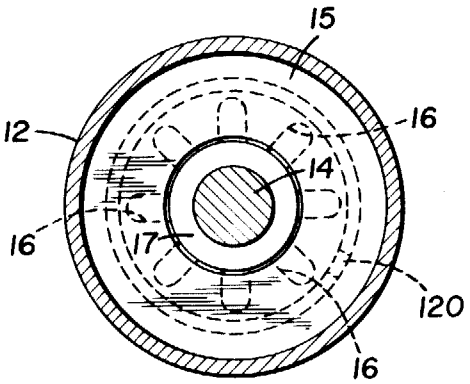
FIG. 9 is a sectional view taken along line 9—9 of FIG. 8.

A suitable hot gas supply source such as a Leosche mill hot gas inlet duct supplies hot air to a first pipe 100 which in turn is connected to chamber 150 at chamber inlet 152. The chamber 150 preferably is curved to conform to the inner casing 170 so as to form a maximum heat exchange area as shown in the drawings. The chamber 150 is located between the discharge opening and door 30. The blades 10 rotate counterclockwise as shown in FIG. 6. The air exit from chamber 150 is through a series of holes 161 at the distal end of chamber 150. The holes open directly into the coal discharging from the feeder so that this air flow assists in drying the coal. As seen in FIG. 8, a plate 155 is connected to bottom wall 74 and inner casing 170. Plate 155 has three holes 162 which may be moved into and out of alignment with corresponding holes behind them. Thus bottom wall 74 also has three holes 161 spaced apart the same distance as holes 162 (see FIG. 6). In FIG. 8, the holes 162 and 161 are aligned to form chamber exits. Lineal movement of plate 155 will regulate the size of the chamber exits. The chamber exits 161–162 allow the hot gas to leave the chamber so as preferably to combine with coal exiting the rotary coal feeder 2 through the discharge opening 5.

Figure 4:
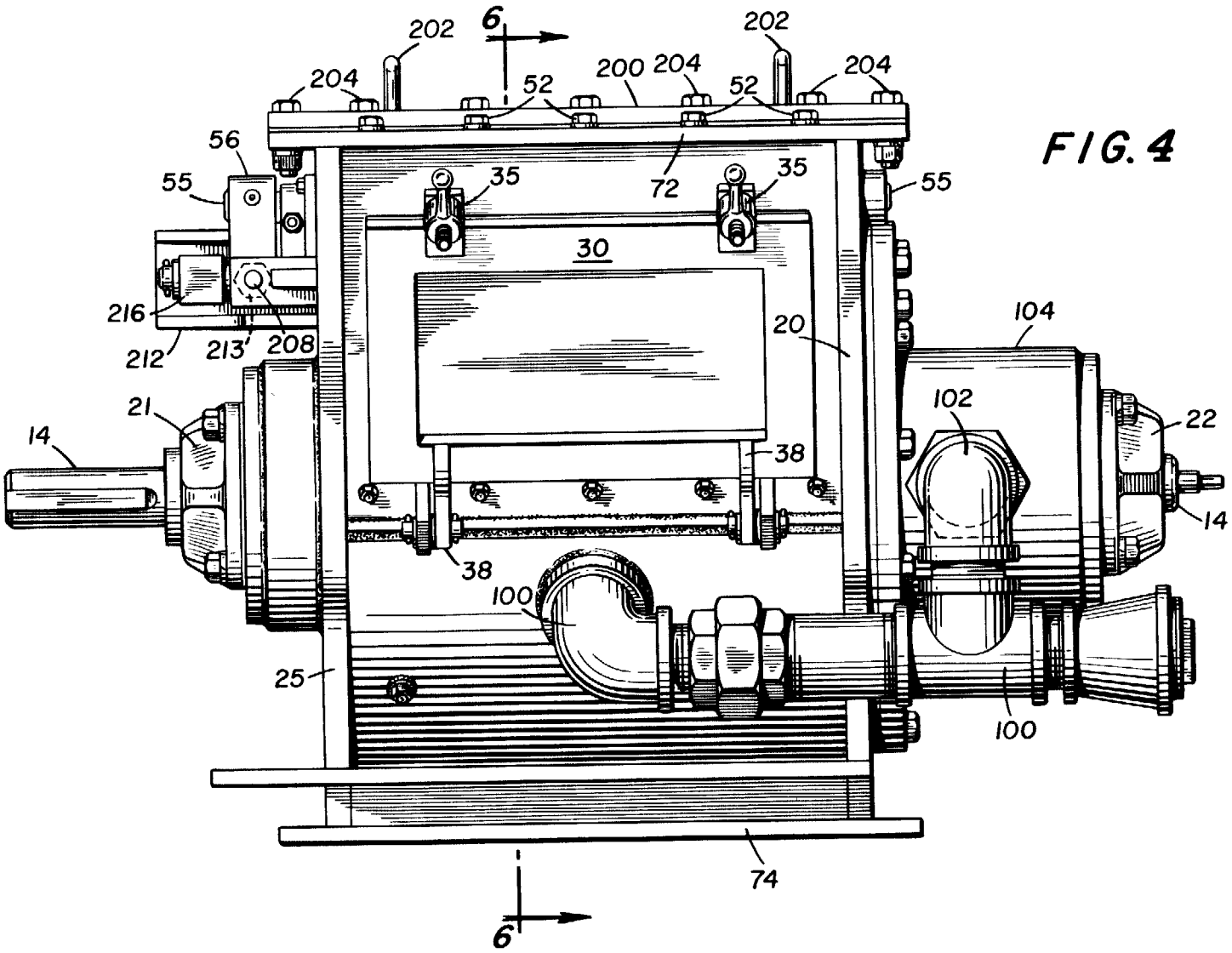
FIG. 4 is an elevational view showing the front of the coal feeder in which the air pipe enter the feeder.
Figure 5:
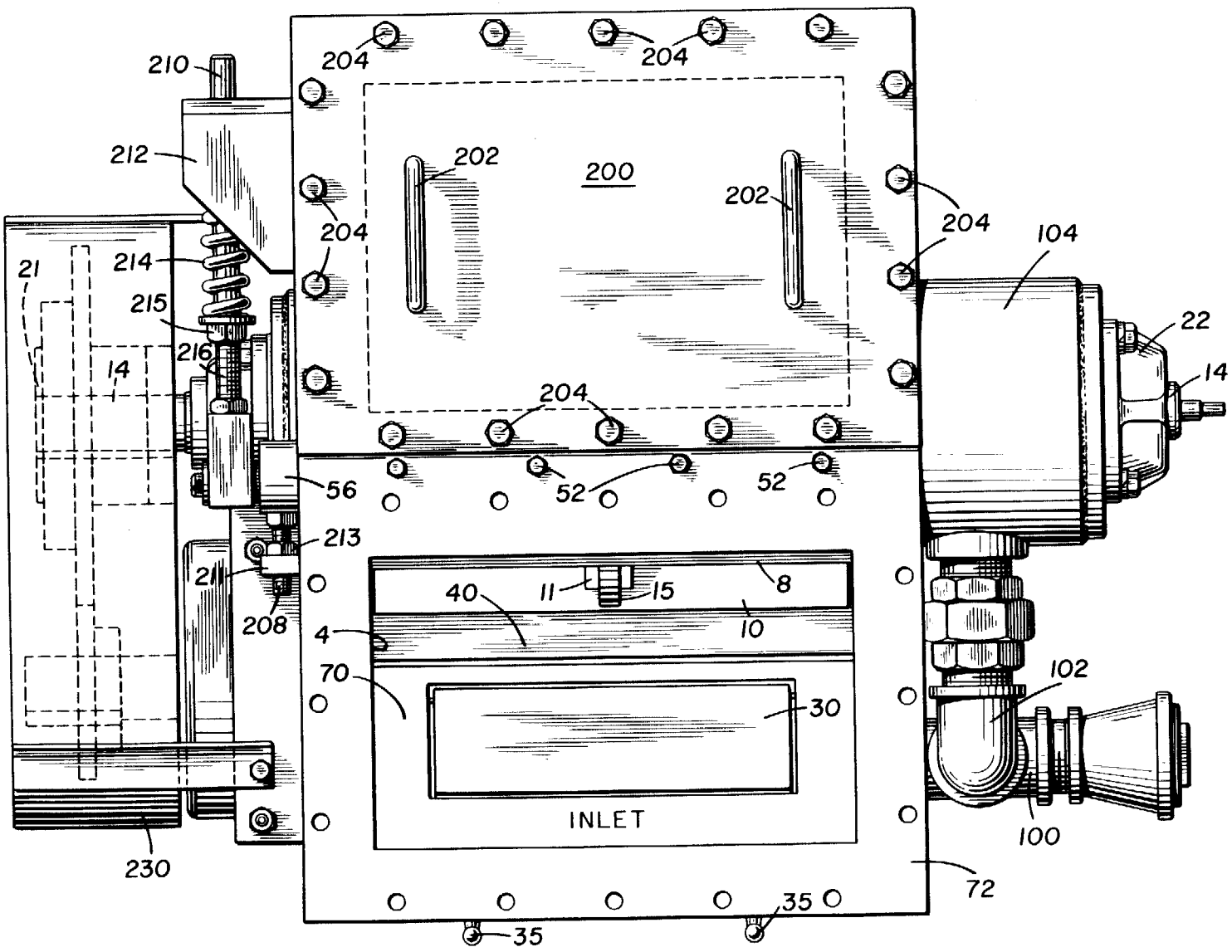
FIG. 5 is a top plan view of the coal feeder.

Also connected to the first pipe 100 is a second pipe 102 through a T connection (see FIG. 4). As can be seen in FIG. 7, the second pipe 102 allows hot air from the first pipe 100 to enter the plenum chamber 104 through inlet 106. The hot gas then exits the plenum chamber through the annular opening 108 and enters the core 12. The hot gas will circulate through the length of the core 12 by passing through holes 16 in disk 15. Disk 15 is attached to bushing 17 which is in turn secured to shaft 14. A plurality of blades 10 are each attached to disk 15 by L-bracket 11. Hot gas discharges from the core 12 through core gas exits 120 which are directed downstream of the discharging coal, facilitating rapid drying of the blades 10 and preventing coal sticking to them. Thus, it can be seen that the relationship between the amount of hot gas which enters the core 12 and which exits at the core gas exits 120 versus the amount of hot gas which enters the chamber 150 and exits at the chamber exits 160 can be made to depend on the difference in air passage diameter between the first pipe 100 and the second pipe 102 and/or preferably, by adjusting the air passage 160 diameter size, by movement of the plate 155 in relation to the desired air flow through core 12. In other words if more air flow is desired through core 12, then the chamber exits 160 would be adjusted to be relatively small whereas if less air is desired through core 12, then chamber exits 160 would be relatively larger so as to establish a preferred hot air travel path through chamber 150.

In a preferred embodiment of this invention, the applicants have utilized three chamber exits 160, and two core gas exits 120. However, there is no reason why this invention could not be utilized with either a fewer or a greater number of exits.

In accordance with the provisions of the statutes we have illustrated and described the best form of embodiment of our invention now known to us, it will be apparent to those skilled in the art that changes may be made in the form of the apparatus disclosed without departing from the spirit and scope of the invention set forth in the appended claims.

What is claimed is:

1. A feeder for lump material such as coal comprising:

a casing having a top inlet opening and a bottom discharge opening and first and second end walls;

a substantially hollow core extending between said first and second end walls and having a gas inlet and at least one gas exit communicating with the inside of said casing;

a shaft rotatably mounted inside the core and having a plurality of arms attached thereto and extending radially outward from said core;

a plurality of blades, each attached to one of said arms whereby the blades are mounted for rotation about said core within said casing and defining a plurality of pockets for carrying lump material from said inlet opening through said casing to said discharge opening;

a chamber in heat exchange relation to the bottom of the casing positioned near the discharge opening and having a gas inlet and at least one gas exit, and first means for supplying hot gas to the gas inlet of the hollow core and second means for supplying hot gas to the gas inlet of said chamber whereby said core and said casing are heated;

said at least one gas exit of the core being positioned to permit hot gas to circulate through said core and be discharged into the casing to heat said blades;

said gas exit of the chamber being positioned to direct gas generally perpendicular to the path of lump material being discharged from said chamber.

2. A feeder for lump material according to claim 1 wherein said core has a plurality of spaced apart gas exits positioned in said core to direct gas downwardly along said blades toward said bottom discharge opening.

3. A feeder for lump material according to claim 1 wherein said first means for supplying hot gas and said second means for supplying hot gas are connected to the common source of hot gas.

* * * * *